US006480082B1

(12) United States Patent
Aihara et al.

(10) Patent No.: US 6,480,082 B1
(45) Date of Patent: Nov. 12, 2002

(54) CIRCUIT BREAKER

(75) Inventors: Kazuya Aihara, Niigata-ken (JP); Terumi Shimano, Niigata-ken (JP); Eietsu Sato, Niigata-ken (JP); Yukihide Yamada, Niigata (JP); Koichi Yokoyama, Niigata-ken (JP); Toru Ohshima, Niigata-ken (JP); Hidetaka Fujita, Niigata-ken (JP); Toshihiro Sekiguchi, Niigata-ken (JP)

(73) Assignee: Hitachi, Ltd., Tokyo (JP)

( * ) Notice: Subject to any disclaimer, the term of this patent is extended or adjusted under 35 U.S.C. 154(b) by 532 days.

(21) Appl. No.: 08/991,602

(22) Filed: Dec. 16, 1997

(30) Foreign Application Priority Data

Dec. 25, 1996 (JP) ..... 8-345350
Feb. 10, 1997 (JP) ..... 9-026941

(51) Int. Cl.[7] ..... H01H 13/04

(52) U.S. Cl. ..... 335/202; 335/16; 200/295; 218/22

(58) Field of Search ..... 335/16, 147, 195, 335/131–2, 202; 200/295–305; 218/22, 26

(56) References Cited

U.S. PATENT DOCUMENTS 5,313,180 A * 5/1994 Vial et al. ..... 335/16
5,381,119 A * 1/1995 Robbins et al. ..... 335/132
5,510,759 A * 4/1996 Gula et al. ..... 335/18
5,534,832 A * 7/1996 Duchemin et al. ..... 335/147

* cited by examiner

*Primary Examiner*—Lincoln Donovan
(74) *Attorney, Agent, or Firm*—Antonelli, Terry, Stout & Kraus, LLP

(57) ABSTRACT

A circuit breaker having a safe construction, where no electrically charged portions are exposed in an accessory installation area or anywhere outside a main circuit case even if a cover of the circuit breaker is opened in a live condition. In order to achieve above object, the circuit breaker of this invention includes the main circuit case made of an insulating material, and an opening-closing trip mechanism disposed outside of the main circuit case and electrically insulated from the main circuit. According to this invention, a circuit breaker capable of eliminating the risk of an electric shock, thereby providing the excellent safety can be obtained.

14 Claims, 11 Drawing Sheets

CIRCUIT BREAKER

BACKGROUND OF THE INVENTION

1. Technical Field of the Invention

This invention relates to a circuit breaker capable of breaking a circuit when an excess current or a short-circuit current flows in a load side, and more particularly to a circuit breaker in which mechanical portions within a casing are electrically insulated from a main circuit to prevent a high voltage from being induced to the mechanical portions.

2. Description of Prior Art

A circuit breaker is a switching gear for automatically breaking a circuit when a short-circuit accident occurs in such a portion as a power transmission-distribution line, a bus bar and equipment in a transformer station, etc. It also breaks the circuit when an excess current flows in a load side. In addition, it is not only used in breaking the circuit, 11 but also used for opening and closing the circuit in a normal condition. In order to protect the circuit, reliable breaking for short-circuit current and excess current is required.

In a conventional circuit breaker as disclosed in FIGS. 16, 20 and 60 of Japanese Patent Unexamined Publication No. 61-151945 (Japanese Patent Examined Publication No. 7-27750), a switching mechanism, provided at a central pole, is mechanically connected through a lower lever to a movable contact carrier at the central pole. An overcurrent tripper within an accessory chamber is provided at each pole, and is fixed to a conductor of each pole.

In the above conventional technique, the switching mechanism, the lower lever and the overcurrent tripper are made of metal. Therefore, the switching mechanism is electrically charged to a potential substantially equal to that of the movable contact carrier at the central pole, and the overcurrent tripper is electrically charged to a potential substantially equal to that of the conductor of each pole. Therefore, when a cover of the circuit breaker is opened exceptionally in a hot-line condition (usually, opening the cover is carried out after interrupting the power) to gain access within the accessory chamber of the circuit breaker, e.g., for adding or exchanging an interior accessory, charged portions of the switching mechanism or that of the overcurrent tripper are especially exposed and may result in accidental user contact, which raises a problem of a dangerous condition.

Particularly dangerous are arrangements which provide some degree of isolation of the circuit, but which still have small main circuit exposure within the accessory chamber. More particularly, electrical workers are lulled into a false sense of safety by the partial (i.e., less than perfect) isolation of the main circuit and thus become more carefree and careless. Eventually such carefree behavior will result in accidential contact with the small exposed main circuit resulting in harm to the electrical worker. Examples of such dangerous partial isolation can be seen in U.S. Pat. No. 5,281,776 Morel et al. and U.S. Pat. No. 5,310,971 Vial et al., which dangerously leave a terminal portion of the main circuit contact terminal strip 25 (FIG. 3 of U.S. Pat. No. 5,281,776) electrically exposed within an accessory chamber. Further related patents are U.S. Pat. Nos. 5,357,066 and 5,298,874. The teachings of all mentioned references are incorporated herein by reference.

SUMMARY OF THE INVENTION

It is a first object of this invention to provide a circuit breaker which eliminates the risk of an electric shock, thereby providing excellent safety.

It is a second object of this invention to provide a circuit breaker having a sufficient durability for i.e., being capable of withstanding a high internal pressure when a short-circuit current occurs at a load side.

It is a third object of this invention to provide a circuit breaker capable of preventing an accessory cover from being handled i.e., removed or accessed by an unauthorized person.

It is a fourth object of this invention to provide a circuit breaker capable of installing or removing interior accessories without removing a main cover plate disposed so as to cover the surface of the circuit breaker in a switch box where the circuit breaker is installed.

It is still a further object of this invention to avoid electrical connection between a main circuit and a tripping mechanism, by instead providing interaction therebetween in the form of an electrical magnetic flux transmitted through a main circuit case.

In order to provide the above and other objects and advantages, the present invention is a circuit breaker comprising a main circuit including a power-side stationary conductor electrically connected to a power-side terminal, a load-side stationary conductor electrically connected to a load-side terminal, and a movable conductor electrically connecting and disconnecting said power-side stationary conductor and said load-side stationary conductor; an opening-closing mechanism mechanically connected to the movable conductor; a main circuit case totally isolating the main circuit from exposure in an accessory chamber and made of an insulating material; and a trip device for causing the opening-closing mechanism to break the main circuit when a current in the main circuit exceeds a threshold value, wherein the opening-closing mechanism and the trip device are electrically insulated from the main circuit.

In another embodiment, the present invention is a circuit breaker comprising a main circuit including a power-side stationary conductor electrically connected to a power-side terminal, a load-side stationary conductor electrically connected to a load-side terminal, and a movable conductor electrically connecting said power-side stationary conductor and the load-side stationary conductor together on an ON operation; an opening-closing mechanism disposed outside of the main circuit case and mechanically connected to open-close the movable conductor, a main circuit case containing the main circuit and tatally isolating the same from exposure within an accessory chamber; and a trip device for causing the opening-closing mechanism to break electrical conduction along said main circuit when a current in the main circuit exceeds a threshold value, wherein the main circuit case is made of an insulating material, and the opening-closing mechanism is connected to the moving conductor through an insulating material.

In a third embodiment, the present invention is a circuit breaker comprising a main circuit including a power-side stationary conductor electrically connected to a power-side terminal, a load-side stationary conductor electrically connected to a load-side terminal, and a movable conductor electrically connecting the power-side stationary conductor and the load-side stationary conductor together on an ON operation; an opening-closing trip mechanism mechanically connected to the movable conductor; a main circuit case containing the main circuit and tatally isolating the same from exposure within an accessory chamber; and a trip device for causing the opening-closing mechanism to break the main circuit when a current in the main circuit exceeds a threshold value; wherein the main circuit case is made of an insulating material and the opening-closing mechanism is disposed outside of the main circuit case, and is electrically insulated from the main circuit, and the trip device includes a transmission mechanism for transmitting an operation of the trip device to the opening-closing mechanism, and the transmission mechanism is disposed outside of the main circuit case, and is electrically insulated from the main circuit.

In yet an additional embodiment, the present invention is a circuit breaker comprising a breaker casing; a main circuit including a power-side stationary conductor electrically connected to a power-side terminal, a load-side stationary conductor electrically connected to a load-side terminal and a movable conductor electrically connecting and disconnecting the power-side stationary conductor and said load-side stationary conductor; an opening-closing mechanism mechanically connected to the movable conductor; a main circuit case containing the main circuit so as to tatally isolate the main circuit from exposure within an accessory chamber and being made of an insulating material; a trip device for causing the opening-closing mechanism to break the main circuit when a current in the main circuit exceeds a threshold value; an accessory area disposed within the casing for accomodating installation of an interior accessory; and an accessory cover disposed on a surface of the casing for covering the accessory area; wherein the opening-closing mechanism, the main circuit case, and the trip device are disposed in the casing, and the opening-closing trip mechanism and the trip device are electrically insulated from the main circuit.

In present invention, since the opening-closing mechanism is electrically insulated from the main circuit, a voltage on the main circuit is not conducted to the opening-closing mechanism. Further, since the main circuit case is constructed to totally isolate the main circuit from exposure within an accessory area, total main circuit isolation is provided. Therefore, a circuit breaker capable of reducing a risk of electrical shock is obtained.

BRIEF DESCRIPTION OF THE DRAWINGS

Other advantages and features will become more clearly apparent from the following description, represented in the accompanying drawings in which:

FIG. 4*a* shows a condition when the current does not exceed the threshold value, and FIG. 4*b* shows a condition when the current exceeds the threshold value and the movable core is attracted to the stationary core.

DETAILED DESCRIPTION OF THE PREFERRED EMBODIMENTS OF THE INVENTION

Figure 1:
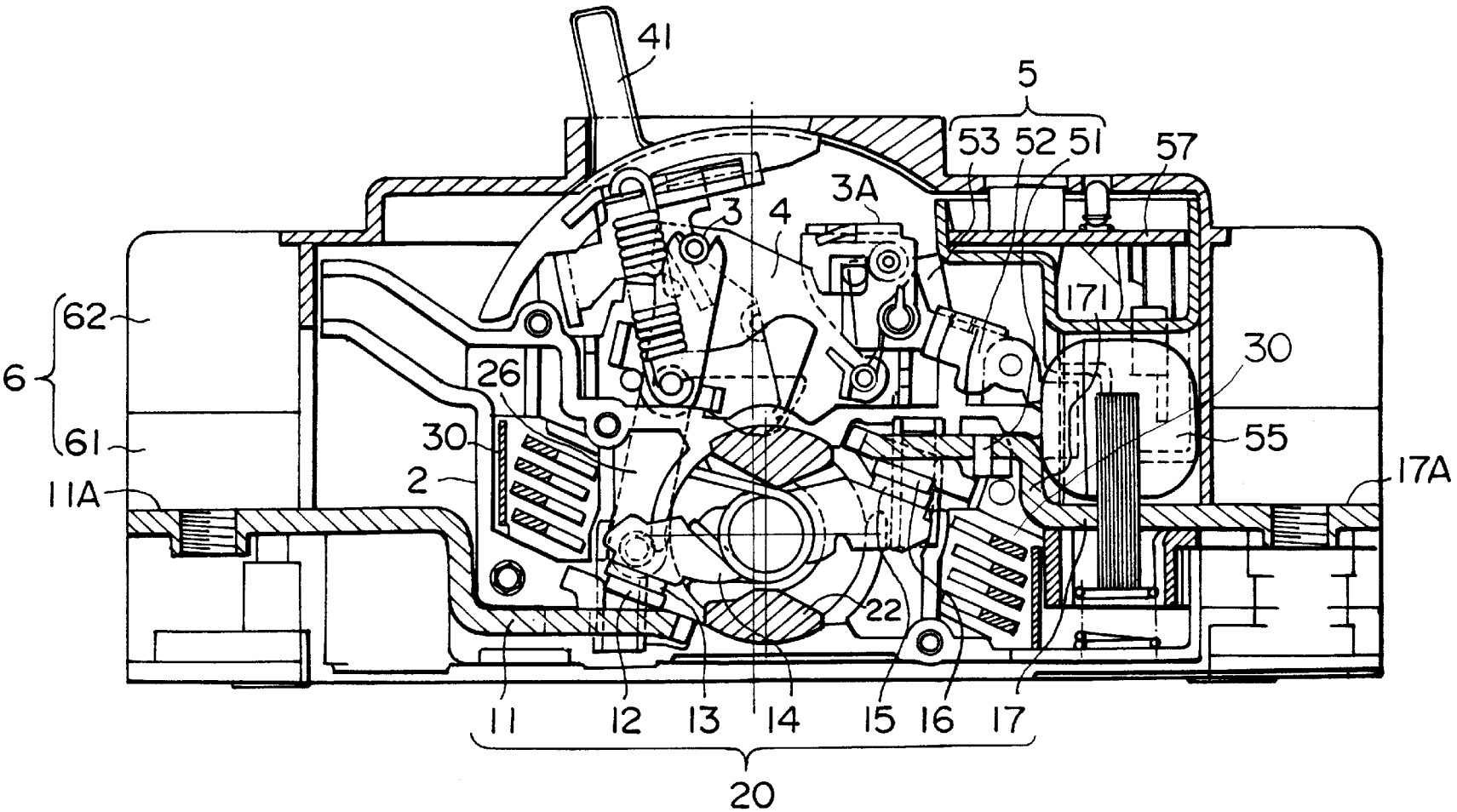
FIG. 1 is a cross-sectional view of a circuit breaker in a preferred embodiment of the present invention.
Figure 2:
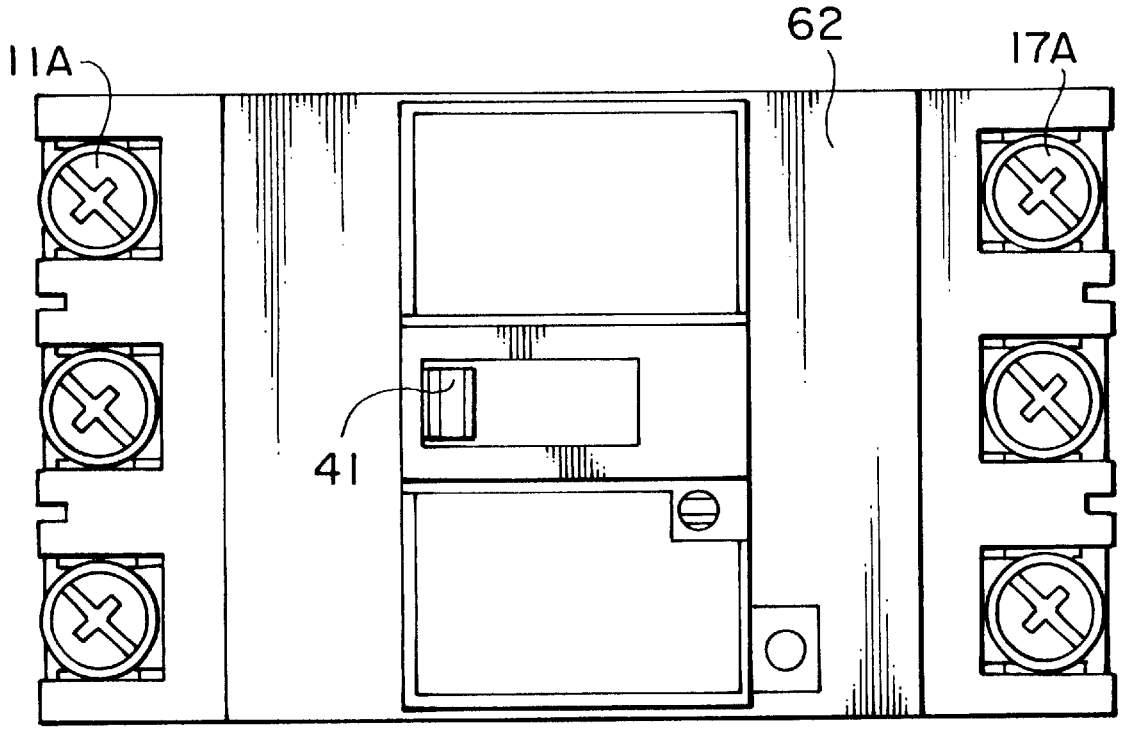
FIG. 2 is a plan view of the circuit breaker in the preferred embodiment of the invention.

The preferred embodiment of a circuit breaker of the present invention will now be described with reference to FIGS. 1 to 15. More particularly, FIG. 1 is a cross-sectional view of the circuit breaker of this embodiment, and FIG. 2 is a plan view of the circuit breaker of this embodiment.

Figure 5:
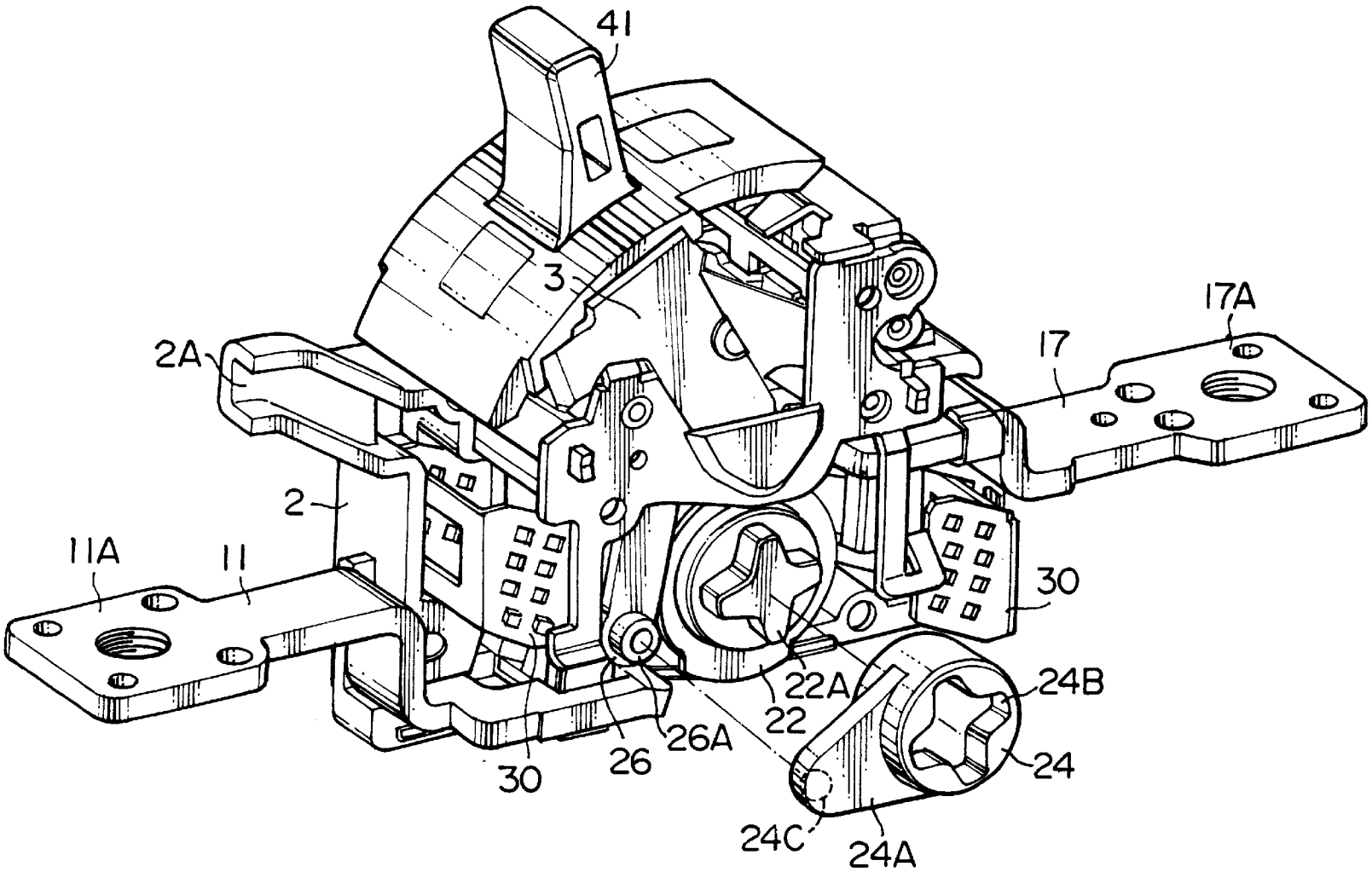
FIG. 5 is a perspective view showing an inside structure of a main circuit case with opening-closing trip mechanism mounted on it in the preferred embodiment of the invention.
Figure 13:
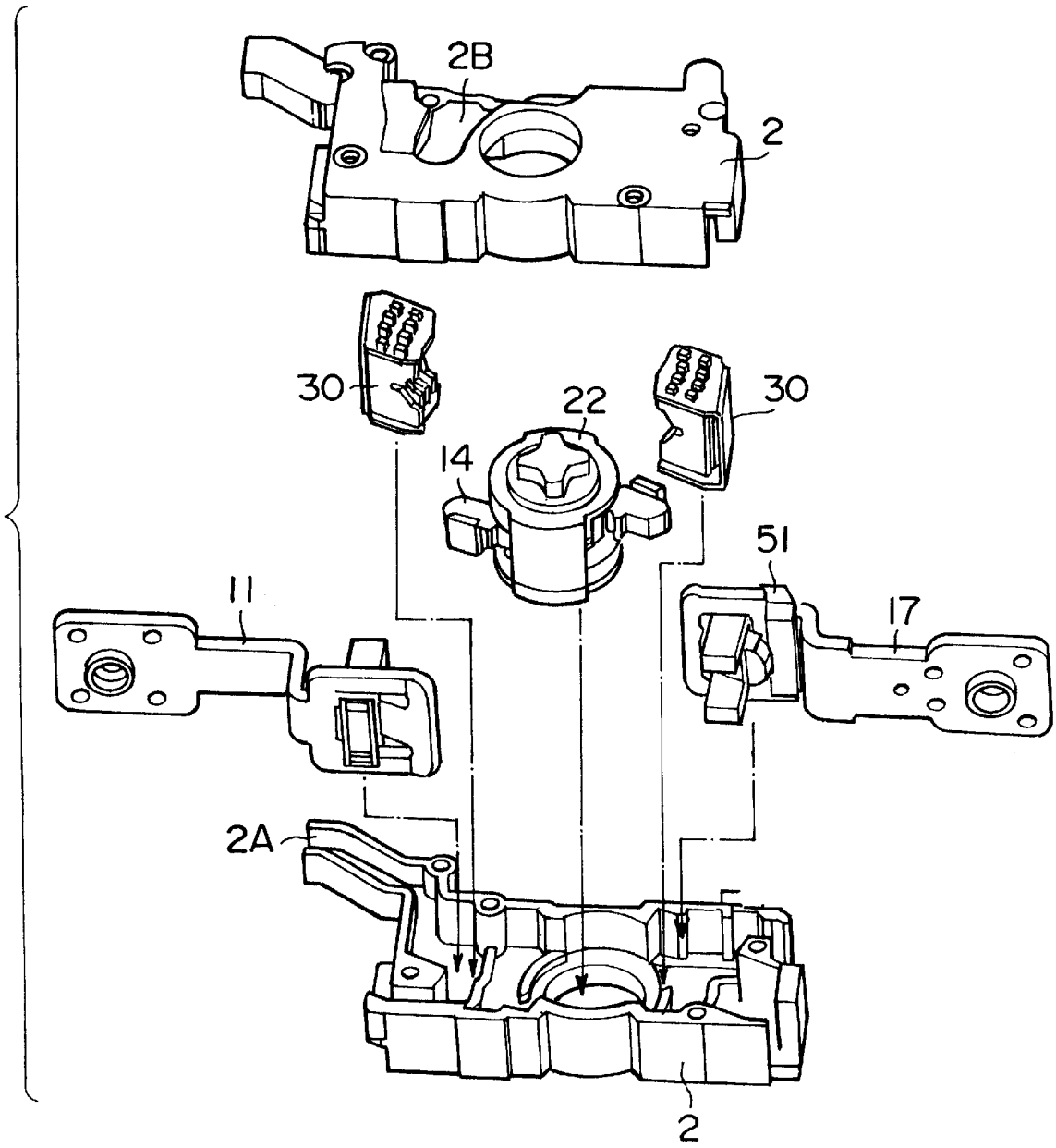
FIG. 13 is a perspective view showing contents of the main circuit case in the preferred embodiment of the invention.

Turning now to more detailed description, the circuit breaker of this embodiment is a three-pole circuit breaker. With respect to each pole, a power-side stationary contact carrier 11, a load-side stationary contact carrier 17 and a movable contact carrier 14 are arranged substantially symmetrically with respect to a rotational axis of the movable contact carrier 14. The power-side stationary contact carrier 11, serving as a power-side stationary conductor, is electrically connected to a power-side terminal 11A. The load-side stationary contact carrier 17, serving as a load-side stationary conductor, is electrically connected to a load-side terminal 17A. The movable contact carrier 14, serving as a movable conductor, is movably held in a predetermined rotational axis. The movable contact carrier 14 is rotatably supported at its substantially center portion and has a power-side movable contact 13 which is fixed at one end portion thereof and a load-side movable contact 15 which is fixed at the other end portion thereof. The power-side movable contact 13 and the load-side movable contact 15 are arranged symmetrically with respect to the rotational axis of the movable contact carrier 14. The power-side stationary contact carrier 11 has a power-side stationary contact 12 disposed in opposed relation to the power-side movable contact 13, and the load-side stationary contact carrier 17 has a load-side stationary contact 16 disposed in opposed relation to the load-side movable contact 15. The power-side stationary contact carrier 11 including the power-side stationary contact 12, the load-side stationary contact carrier 17 including the load-side stationary contact 16 and the movable contact carrier 14 including both the power-side movable contact 13 and the load-side movable contact 15 constitute a main circuit 20. This main circuit 20 is contained in a main circuit case 2 as shown in FIGS. 1, 5 and 13. A circuit breaker case 6 includes a bottom case 61 and a cover 62, and encloses the main circuit case 2 therein.

Figure 6:
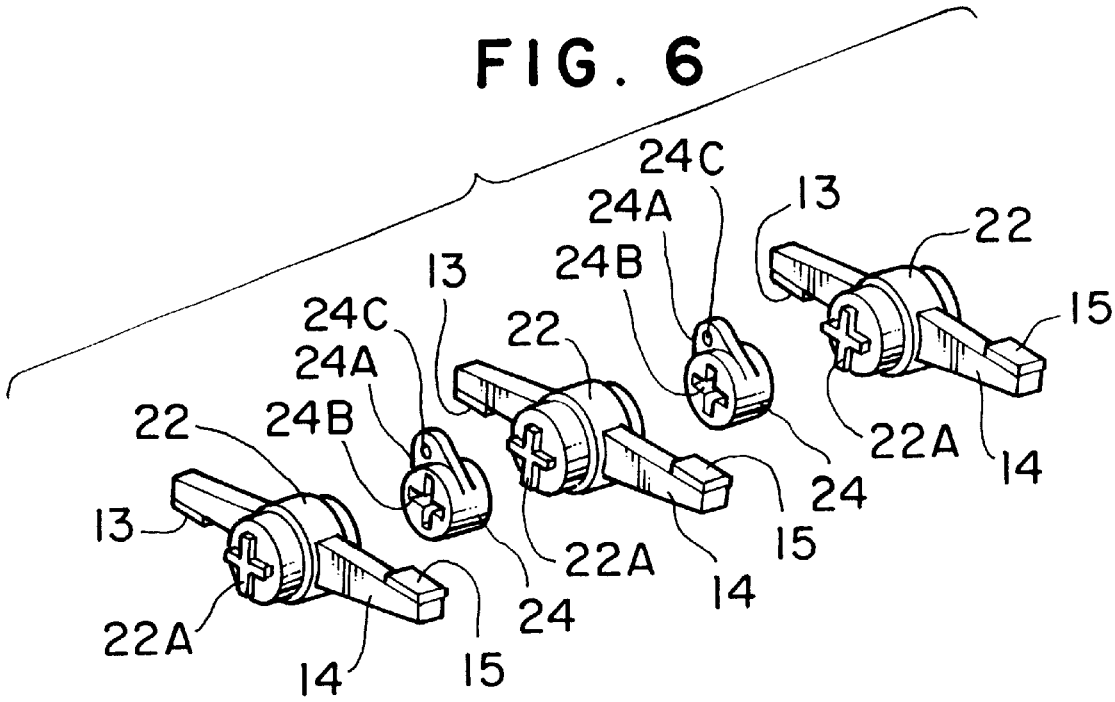
FIG. 6 is a perspective view of a connecting member and a holding member with a movable contact carrier supported in it in the preferred embodiment of the invention.
Figure 7:
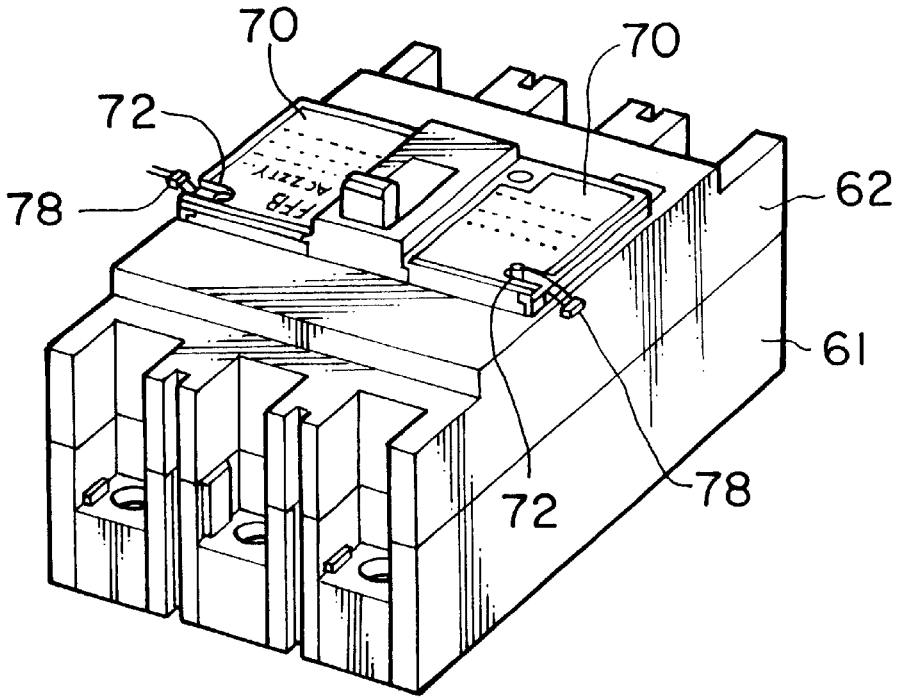
FIG. 7 is a perspective view of the circuit breaker with accessory covers closed in the preferred embodiment of the invention.
Figure 14:
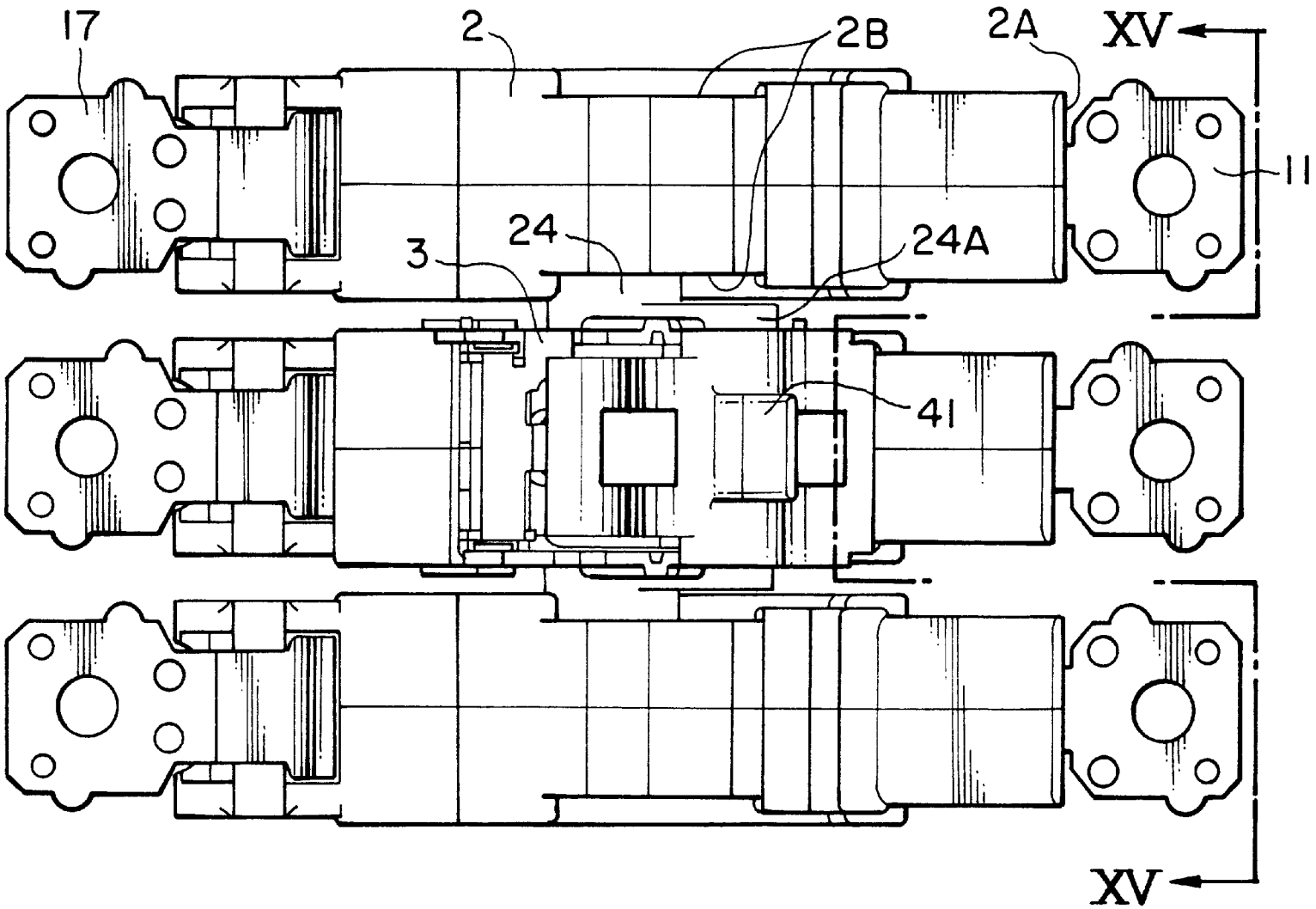
FIG. 14 is a plan view of the main circuit cases connected side by side in the preferred embodiment of the invention.
Figure 15:
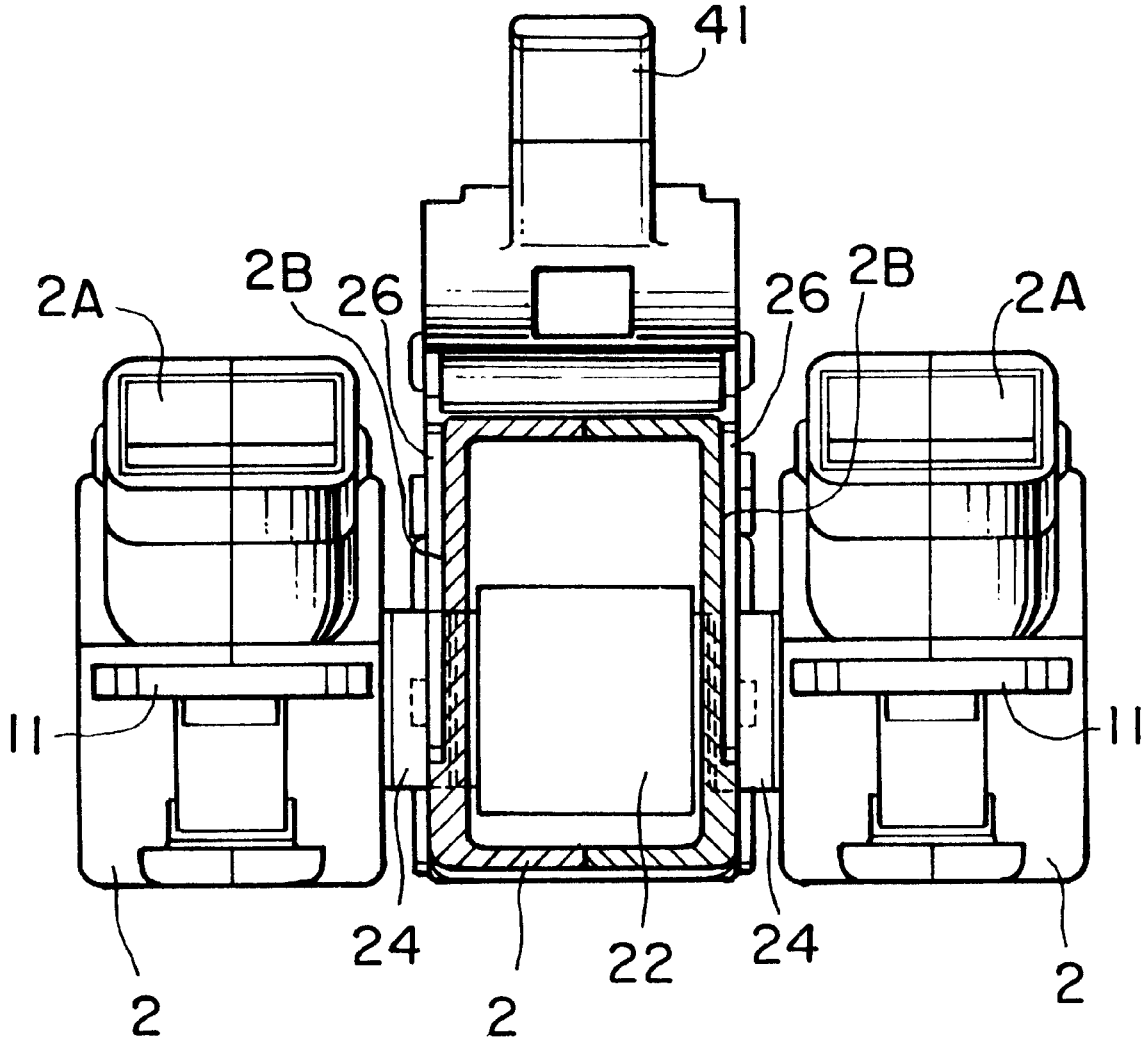
FIG. 15 is a partial cross-sectional view of the main circuit cases showing a relation of the connecting lever, the connecting member and the holding member in the preferred embodiment of the invention.

In this embodiment, a holding member 22 for holding the movable contact carrier 14 within the main circuit case 2 is disposed rotatably around the axis of the movable contact carrier 14. The movable contact carrier 14 is rotatably supported on the holding member 22. The holding member 22 is made of an insulating material. The holding member 22 of each pole is connected to the holding member 22 of any adjacent pole by a connecting member 24 as shown in FIGS. 6, 14 and 15 so as to enable a coincident rotation of the holding members 22. In FIG. 15, a cross-section of the main circuit case 20 in the central pole is dislosed. In this cross-section, power source side stationary conductor 11, movable conductor 14 and arc chute 30 are omitted. In this embodiment, the holding member has a + (plus) shaped projection 22A (FIG. 6) on both sides perpendicular to its rotational axis. The connecting member 24 has a + (plus) shaped recess 24B on both sides perpendicular to its rotational axis. The + shaped recess and the + shaped projection are connected in mating relation so as totransmit forces therebetween and rotate coincidently. The recess 24B and the projection 22A are not limited to the plus shape. They may be formed in such a shape as can prevent their mating portion from causing a delay in rotation due to slipping motion therebetween. In order to achieve a tight mating without a delay in rotational direction, they may be such polygon-shaped as triangle-shaped, rectangle-shaped, square-shaped, pentagon-shaped, hexagon-shaped, and so on. In case of opening and closing operations in normal condition and in case of tripping action due to an excess current (generally about 110–1000% of a normal current value) flowing in the load side, the movable contact carrier 14 rotates together with the holding member 22. However, in case of a short-circuit current (generally more than 1000% of the normal current value) flowing in the load side, the movable contact carrier 14 itself rotates first to an opening direction of the contacts 13, 11 and 15, 16 by an electromagnetic repulsion force between the movable contact carrier 14 and stationary contact carriers 11 and 17. After this repulsion, a tripping device detects short-circuit current and drives a opening-closing mechanism portion 3 serving as an opening-closing trip mechanism to trip and open the main circuit.

The movable contact carrier 14 is mechanically connected to an opening-closing trip mechanism portion 3 through the holding member 22, the connecting member 24 and a connecting lever 26. The connection lever 26 (FIG. 5) is also made of an insulating material. The connection lever 26 and the connecting member 24 mechanically cooperate to translate a linear motion along connection lever 26 into rotational movement of the connecting member 24 and vice versa. The connection lever, in turn, cooperates with other circuit breaker components and especially the opening-closing trip mechanism 3, to translate or transmit mechanical motions and forces therebetween. Thus such cooperating components form a mechanical circuit for translating and/or transmitting mechanical forces and motions. When the opening-closing trip mechanism portion 3 is turned ON, the movable contact carrier 14 is rotated into a position where the movable contact carrier 14 electrically connects the power-side stationary contact carrier 11 and the load-side stationary contact carrier 17.

This main circuit is assembled and contained in a main circuit case 2 made of an insulating material as shown in FIGS. 1, 5 and 13. In this embodiment, the main circuit case 2 is formed from two members. These two members have a symmetrical shape, and they are combined and secured after the main circuit 20 is contained herein. In FIG. 5, only one of the two members is depicted so as to show the contents of the main circuit case 2 after the main circuit 20 is assembled and contained. When the main circuit 20 is contained in the main circuit case 2, the power-side terminal 11A of the power-side stationary contact carrier 11 and the load-side terminal 17A of the load-side stationary contact carrier 17 are projected from the main circuit case 2, but the other portions are disposed within the main circuit case 2 and electrically insulated from the exterior. Thus, these two exposed portions e.g. the power-side terminal 11A and the loadside terminal 17A, are charged portions when the main circuit is live. Of particular importance, the main circuit case 2 totally isolates the main circuit from being exposed to other internal areas within the circuit breaker, e.g., from being exposed to an accessory installation area.

In this embodiment, the main circuit case 2 and the holding member 22 are made of such a durable thermosetting resin as a polyester resin. At the time of breaking i.e., mechanical interrupting the circuit, an arc gas with high temperature and high pressure is generated between the stationary contact and the movable contact both on the power-side and load-side within the main circuit case 2. Therefore, the main circuit case 2 and the holding member 22 are required to withstand such high-temperature and high-pressure arc gas. As for the material of the main circuit case 2, in view of the cost of the product, a polyester resin is used. Any other resin or a ceramics material may be used as an insulating material for the main circuit case 2, as long as it is capable of withstanding the high-temperature and high-pressure arc gas.

Arc chutes (arc-extinguishing devices) 30 for drawing and cooling the arc, generated at the time of breaking the circuit, are provided in the vicinity of the contacts of the power-side stationary contact carrier 11, the load-side stationary contact carrier 17 and both the power-side contact and the load-side contact of the moving contact carrier 14 in the main circuit case 2. In this embodiment, an arc discharge port 2A for discharging the cooled arc gas is provided in the main circuit case 2.

In a preferred embodiment, multiple main circuit cases 2 are arranged in a juxtaposed manner for a three pole arrangement. The holding members 22 are connected so that the moving contact carriers of the three poles can be driven coincidently or substantially simultaneously both in opening and in closing the main circuit. In this embodiment, the opening-closing mechanism portion 3 is mounted on an upper portion of the outer side of the main circuit case 2 of the central pole. As shown in FIGS. 13–15, the main circuit case 2 has a recess portion 2B on both sides. The connecting lever 26 is disposed in this recess portion 2B as shown in FIG. 15. The connecting member 24 has a rotational arm 24A of an insulating material. An engaging portion 24C (FIG. 6) is formed on the rotational arm 24A. The connecting member 26 also has an engaging portion 26A at its end portion. This rotational arm 24A is disposed coaxially to the rotation shaft of the holding member 22, and is connected to the connecting lever 26 of the opening-closing mechanism 3 by engaging the engaging portions 24C and 26A. Thus, the opening-closing trip mechanism portion 3 is provided outside of the main circuit case 2, and is connected to the movable contact carrier 14 so as to be electrically insulated from the main circuit. Therefore even when the main circuit is live, the voltage is not conducted to the opening-closing mechanism 3 or exposed whatsoever into the accessory installation area. Further, improvement in safety is achieved, because double insulation layers, i.e., the main circuit case 2 and the circuit breaker case 6, are disposed between the contacts 12, 13, 15, 16 and an outer surface of the circuit breaker case 6.

Figure 8:
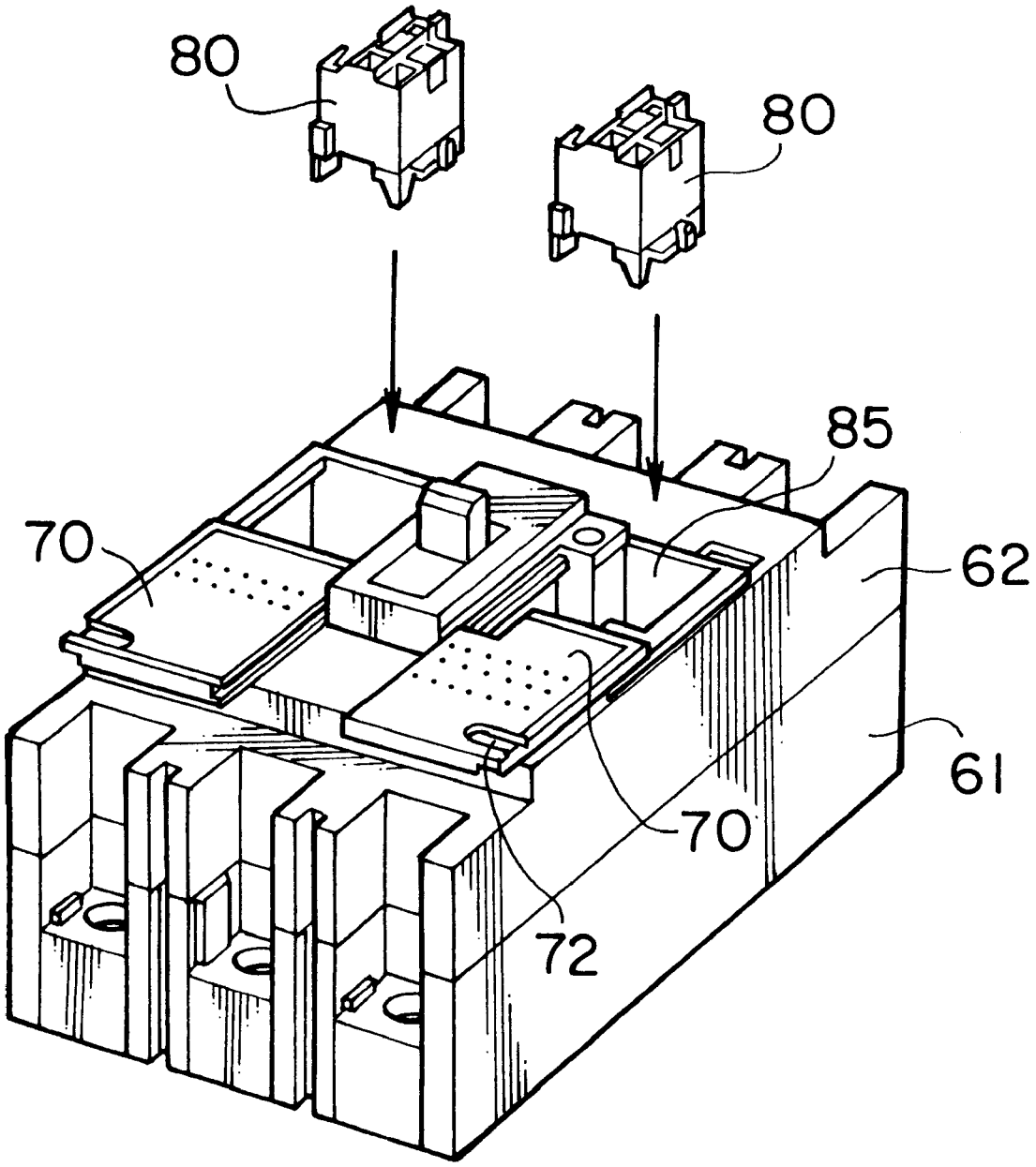
FIG. 8 is a perspective view of the circuit breaker with accessory covers opened, and further showing interior accessories before they are installed in the preferred embodiment of the invention.

In this embodiment, an interior accessory 80 (FIG. 8), which may be, for example, an alarm switching device for outputting a condition of the circuit breaker to an external alarm device (not shown), an auxiliary switching device, a voltage trip device responsive to a signal from an external tripping switch (not shown) for urging a tripping operation, and an undervoltage trip device, can be installed in installation portions 85 of the casing 6 as shown in FIG. 8. These interior accessories 80 are installed, for example, above the poles disposed adjacent to the central pole, and are disposed in either side or in both sides of the opening-closing trip mechanism portion 3, respectively. Since the opening-closing trip mechanism portion 3 is insulated from the main circuit and the main circuit is not at all exposed within the accessory installation area, a risk of electrical shock is reduced in case of attaching or removing the interior accessory 80.

The opening-closing trip mechanism portion 3 is manually operated by an operating handle 41 to turn ON the main circuit, and when the current in the main circuit exceeds a threshold value, the breaking of the main circuit is urged by a tripping device 5.

Figure 3:
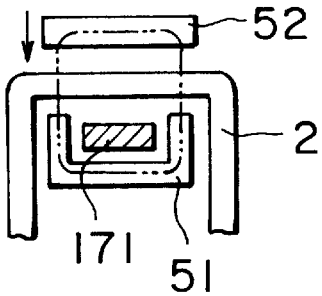
FIG. 3 is a cross-sectional view in a perpendicular direction to that of a conductor explaining an arrangement of a stationary core and a movable core in the preferred embodiment of the invention.
Figure 4A:
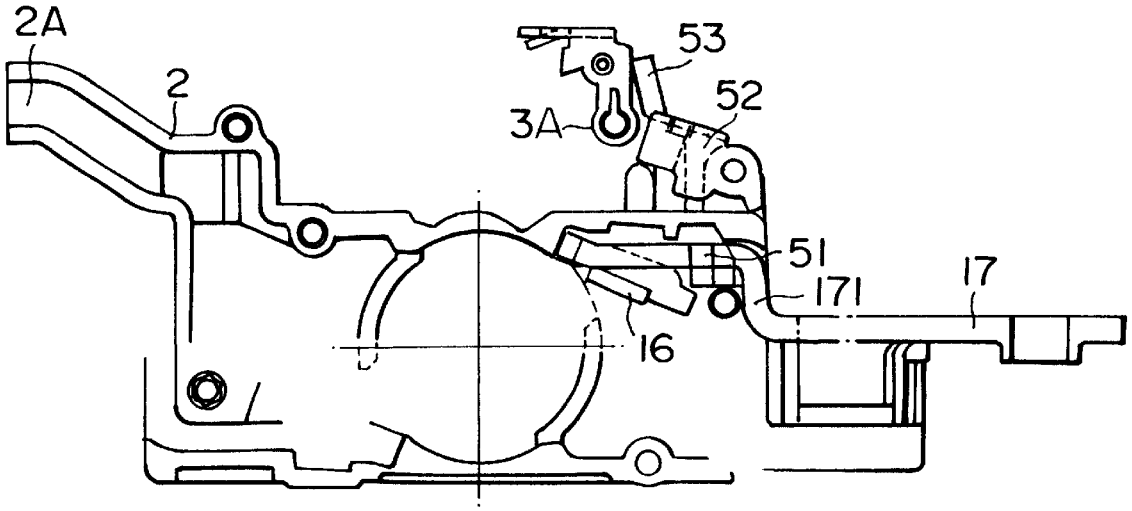
FIGS. 4*a* and 4*b* are each a cross-sectional view along an extending direction of the conductor explaining a magnetic circuit between the stationary core and the movable core in the preferred embodiment of the invention. More particularly.
Figure 4B:
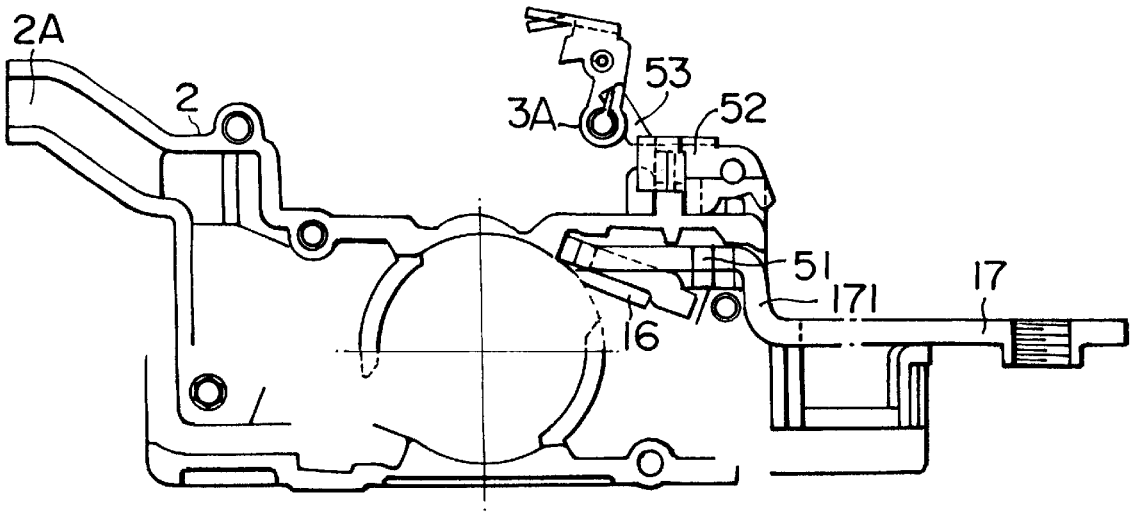

FIG. 3 is a cross-sectional view in a perpendicular direction to that of a conductor 171 explaining an arrangement of a stationary core 51 and a movable core 52 of the tripping device 5 in this embodiment, while FIGS. 4*a* and 4*b* are cross-sectional views along an extending direction of the conductor 171 explaining a magnetic circuit between the stationary core 51 and the movable core 52 in this embodiment. More particularly, in FIGS. 4*a* and 4*b*, main parts for picking up a short-circuit current include a load-side stationary contact carrier 17, the stationary core 51, the movable core 52, a transmission lever 53 and a latch portion 3A are disclosed and other parts are omitted in the drawing. FIG. 4*a* shows a condition when the current does not exceed the threshold value and the movable core 52 is not energized. FIG. 4*b* shows a condition when the current exceeds the threshold value and the movable core 52 is energized and attracted to the stationary core 51. The tripping device 5 comprises the stationary core 51, movable core 52 and the transmission lever 53. The stationary core 51 is provided inside of the main circuit case 2 and is disposed near to the load-side stationary contact carrier 17. The movable core 52 is provided outside of the main circuit case 2 and is so arranged as to form a magnetic circuit between the movable core 52 and the stationary core 51. The transmission lever 53 serves as a transmission mechanism for transmitting the operation of the moving core 52 to the opening-closing mechanism portion 3.

As shown in FIG. 3, the stationary core 51 has a U-shaped cross-section, and surrounds a conductor 171 of the load-side stationary contact carrier 17, and the stationary core 51 is so arranged that both ends of the U-shaped cross-section are directed toward the outside of the main circuit case 2 (that is, directed upwardly in FIGS. 3, 4*a* and 4*b*).

In this embodiment, although the stationary core 51 is disposed at the load-side stationary contact carrier 17 so that the trip device 5 can be provided near to a latch portion 3A of the opening-closing trip mechanism portion 3, the stationary core 51 may be disposed near to the power-side stationary contact carrier 11 by changing the configurations of the movable core 52 and the transmission lever 53. On the other hand, the movable core 52 is rotatably held at one end thereof, and is opposed to the stationary core 51 through an insulating layer of the main circuit case 2 so as to form a substantially-closed magnetic circuit together with the stationary core 51.

The moving core 52 is urged by a spring, and is normally kept spaced a predetermined distance gap from the stationary core 51. When the current in the main circuit increases, and exceeds a threshold value (about 10 to about 20 times larger than the rated current), a magnetic flux generated around the conductor 171 of the load-side stationary contact carrier 17 increases, so that a magnetic flux flowing through the stationary core 51 provided in surrounding relation to this conductor 171 and the moving core 52, also increases. As for a preferred threshold value, some circuit breakers have predetermined fixed values, while the other have adjustable values.

When the magnetic force due to this magnetic flux overcomes the force of the spring urging the movable core 52, the movable core 52 is attracted by and moved toward the stationary core 51, and is finally brought into close proximity with the stationary core 51 through the insulating layer of the main circuit case 2, thereby forming the closed magnetic circuit. The movable core 52 has such a configuration as to cooperate with the stationary core 51 of a U-shaped or an I-shaped cross-section to form the magnetic circuit.

More particularly, as for the figure of the stationary core and the movable core, the stationary core 51 may have an I-shaped cross-section whereas the movable core 52 may have a U-shaped cross-section, or each of the stationary core 51 and the movable core 52 may have a U-shaped cross-section. The magnetic circuit may be provided in a recess formed in the main circuit case 2.

A very important feature to note is that when the arrangement of the magnetic circuit, comprising the stationary core 51 and the movable core 52, is used, the main circuit wholly surrounded in the interior of the main circuit case 2 is electrically insulated from the exterior or other accessory installation areas within the circuit breaker, and therefore when performing an operation, with the cover 62 opened, there exists no high voltage exposure in the vicinity of the other installation areas, so that an electrical shock danger on the part of the user can be reduced.

The transmission lever 53 is formed on the other end of the movable core 52. When the movable core 52 is attracted and moved towards the stationary core 51 (in a counter-clockwise direction in FIGS. 1 and 4), the transmission lever 53 abuts against the latch portion 3A to move the latch portion 3A pivotally (in a clockwise direction in FIGS. 1 and 3), which releases a hook of the opening-closing mechanism 3. Thus the opening-closing mechanism portion 3 opens the main circuit 20 by a tripping operation caused by the release of the hook 4. As a result, the circuit is interrupted, thereby preventing a large excess current from flowing in the load. In this embodiment, since the movable core 52 is provided outside of the main circuit case 2 made of insulating material, voltage is not conducted to the movable core 52 even when the main circuit is energized. Thus, the movable core 52 and the transmission lever 53 of the trip device 5 are non-charged portions by being electrically insulated from the main circuit.

In this embodiment, not only the opening-closing mechanism portion 3 but also the trip device 5 are insulated from the main circuit to form non-charged portions. The non-charged portion is completely separated from the electrically charged portion. Therefore, the charged portions will not be exposed, even when a cover of the circuit breaker is opened exceptionally in a hot-line condition, e.g., for adding or exchanging the trip device 5 or other interior accessories. As a result, the circuit breaker having excellent safety can be obtained.

In this embodiment, a current transformer 55 for detecting the current flowing in the main circuit can be provided in a portion of the main circuit extending from the main circuit case 2 of the load-side stationary contact carrier 17 to the load-side terminal 17A, and an output of this current transformer 55 is fed to an overcurrent detection circuit 57 provided above the current transformer. The current transformer arrangement is likewise a protective portion of the main circuit case in that the current transformer (like the main circuit case halves; FIG. 13) is designed and arranged to prevent any type of main circuit exposure within the other accessory installation areas of the circuit breaker, i.e., the current transformer totally surrounds and thus electrically isolates a corresponding portion of the main circuit. Also, by use of the current transformer (like the previously discussed magnetic circuit), prevents electrical connection of the high voltage of the main circuit into the other accessory installation areas of the circuit breaker.

In accordance with predetermined time delay characteristics, the overcurrent detection circuit produces an output within the range of approximately 1.1 to approximately 20 times larger than the rated current. The output of the overcurrent detection circuit is fed to a magnetic trip device (not shown) in which a movable core, attracted by a permanent magnet, is released by reverse excitation (a coil disposed in the magnetic trip device is excited so as to cancel a magnetic flux of the permanent magnet.). A device, disclosed, for example, in Japanese Patent Unexamined Publication No. 9-260136, can be used as such a magnetic trip device. The teachings of such reference are incorporated herein by reference. The movable core of the magnetic trip device, when released, abuts against the latch portion 3A to pivotally move the latch portion 3A (in a clockwise direction in FIGS. 1, 4*a* and 4*b*), so that the main circuit is opened by the tripping operation of the opening-closing trip mechanism portion 3. As a result, the circuit is interrupted, thereby preventing a large excess current from flowing in the load.

The main circuit cases 2, the opening-closing mechanism portion 3, the trip device 5, the current transformer, the overcurrent detection circuit and the magnetic trip device are contained in a casing 6 having a case 61 and a cover 62. A handgrip portion of the operating handle 41 connected to the opening-closing trip mechanism portion 3 and the power-side terminals 11A and the load-side terminals 17A are exposed to the exterior of the casing 6.

In this embodiment, since the movable contacts and the stationary contacts of the main circuit are contained in the main circuit case 2 made of an insulating material capable of withstanding high-temperature and high-pressure arc gas, the casing 6 need only to have the required minimum durability. Therefore, an inexpensive thermosetting resin such as nylon can be used for this casing.

In this embodiment, accessory covers, which can be opened and closed, are provided at a surface side of the casing 6 (at which the operating handle 41 is provided), on both sides of the operating handle 41. By opening these accessory covers, various interior accessories (i.e., in addition to the opening-closing mechanism 3 accessory) can be installed, or can be exchanged for maintenance purposes. In this embodiment, even when these accessory covers are exceptionally opened in a hot-line condition, the charged portions of the main circuit are not exposed therein, and the maintenance operation for the interior accessories can be performed in a safe manner.

As described above, in this embodiment, no charged portion of the main circuit is exposed in the accessory installation area even when the accessory cover is opened exceptionally. However, in order to keep the interior accessory in good and reliable condition, it is not desirable that unauthorised persons open the cover at any time. In this embodiment, accessory covers 70 are disposed on the surface of the cover 62. These accessory covers 70 are slidably supported by mutually engaging recessed grooves 64 (FIG. 9) on both sides thereof with a projecting portion 66 formed on the cover 62. Since the accessory covers 70 are opened or closed independently of the cover 62, installation and maintenance of the interior accessories 80 can be achieved just by opening the accessory covers 70, i.e., with the main cover 62 remaining closed. The accessory covers 70 are capable of opening by sliding them towards a power-source side and are capable of being locked in a closed position in order to prevent the interior accessory from being accessed and handled by an uncertified worker. When an interior accessory 80 is installed in the casing 6 of the circuit breaker, at least one of the accessory covers 70 is opened as shown in FIG. 10 (In FIG. 10, both of the accessory covers 70 are opened to install two interior accessories 80. However, in case of installing one interior accessory 80, only one of the accessory covers 70 need be opened.). Under the accessory covers 70, installation portions or areas 85 for accomodating the interior accessory 80 are formed in the casing 6. After installing the interior accessories 80, the accessory covers 70 are closed as shown in FIG. 9 and locked respectively by such lock mechanisms as shown in FIG. 9 or FIG. 11.

Figure 9:
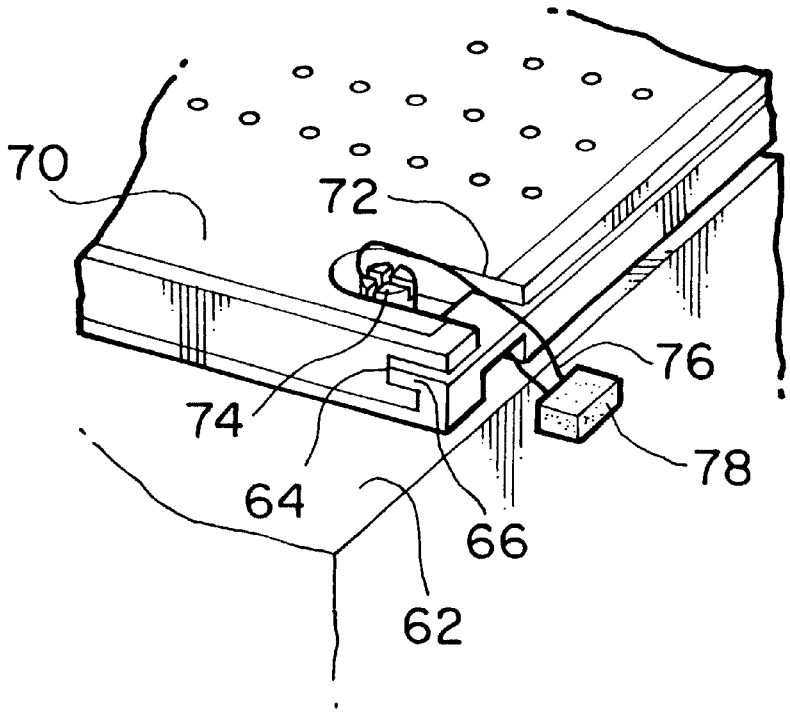
FIG. 9 is a perspective view showing a main part of a lock mechanism for the accessory cover in the preferred embodiment of the invention.
Figure 10:
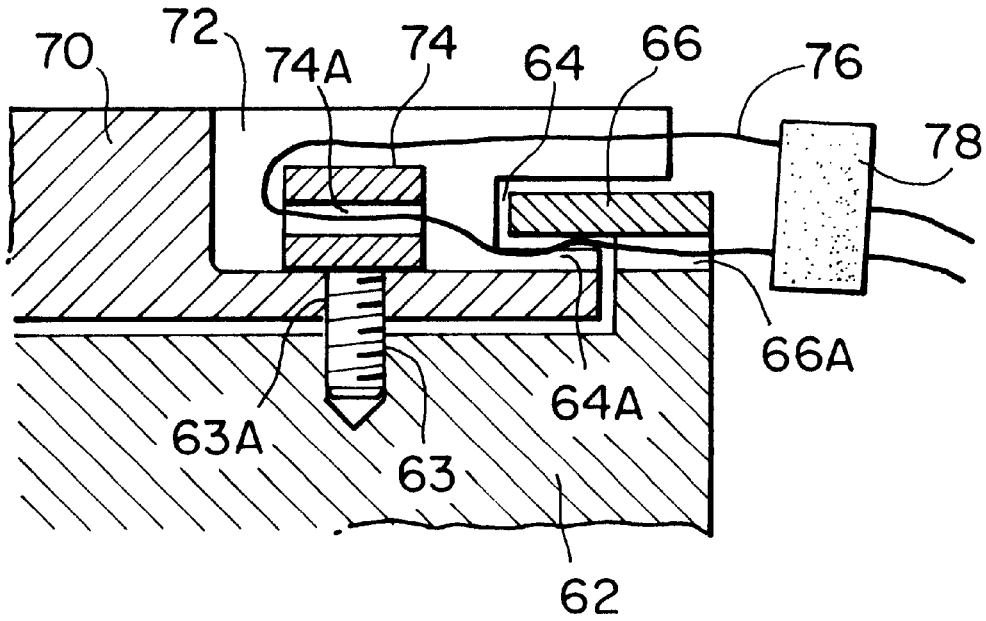
FIG. 10 is a cross-sectional view of the main part of the lock mechanism for the accessory cover in the preferred embodiment of the invention.

As for the lock mechanism shown in FIG. 9 and FIG. 10, a notched hole 72 of a semi-oval shape is formed in the accessory cover 70. As shown in FIG. 10, a through-hole 63A is formed in the accessory cover 70 and screw hole 63 is formed in the cover 62. A lock screw 74 is located in a generally central portion of the notched hole 72, and is threaded into the screw hole 63 via the through-hole 63A to fix the accessory cover 70 to the cover 62, thus locking the accessory cover 70. A radial through hole 74A is formed in a lower portion of a peripheral surface of a head of the lock screw 74. A through-hole 64A is also so formed in each of the opposite grooves 64 of the cover 62 that the through-hole 64A extends horizontally in a direction perpendicular to the direction of sliding of the accessory cover 70. The lock screw 74 is turned to bring the through-hole 74A into alignment with the through hole 64A in a direction substantially perpendicular to the direction of sliding of the accessory cover 70. Then, a wire 76 is introduced into the notched hole 72, and is passed through the aligned through-holes 66A, 64A and 74A. Opposite ends of the wire 76 are sealed by a lock band 78. Thus, the accessory cover 70 is locked.

Figure 11:
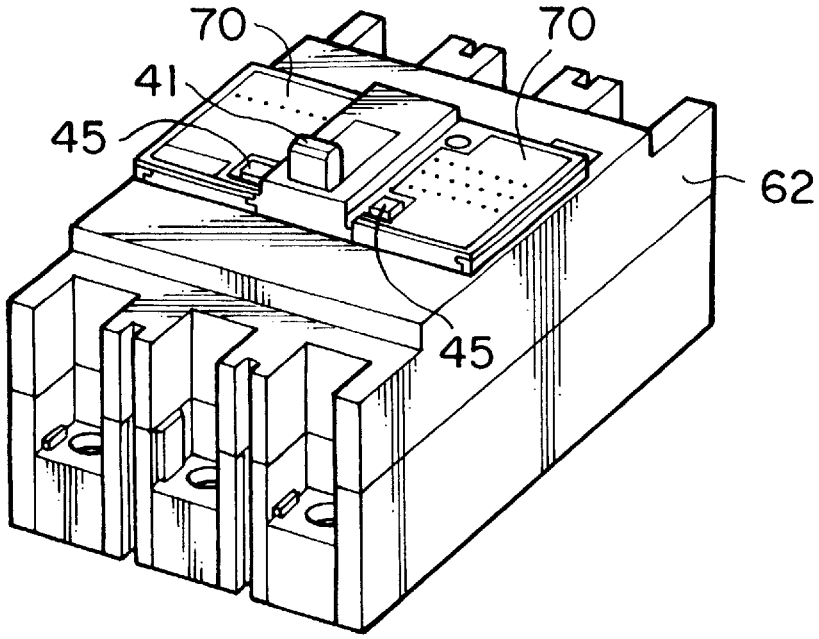
FIG. 11 is a perspective view of a circuit breaker with another type of a locking mechanism showing a condition of an ON-state in the preferred embodiment of the invention.
Figure 12:
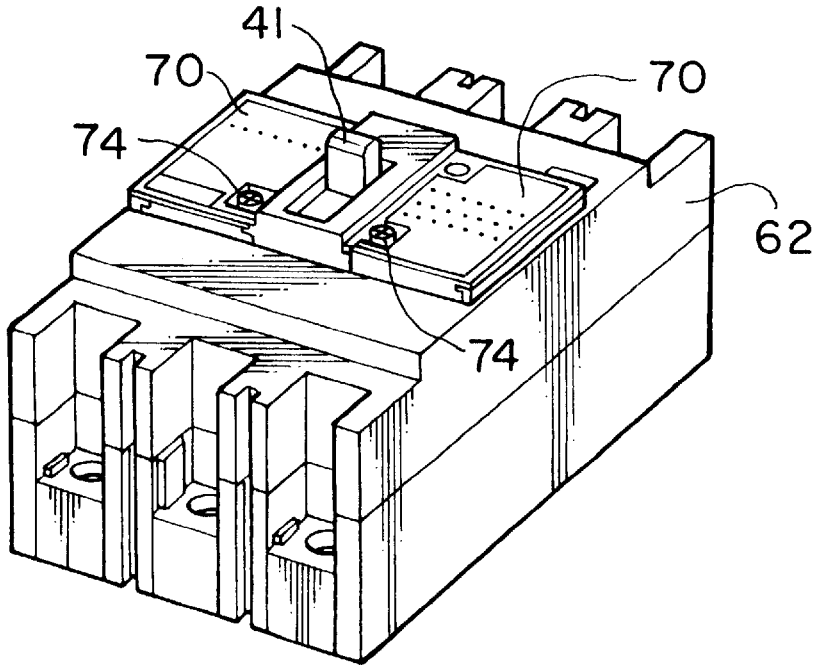
FIG. 12 is a perspective view of a circuit breaker with another type of a locking mechanism showing a condition of an OFF-state in the preferred embodiment of the invention.

As for the lock mechanism shown in FIG. 11 and FIG. 12, the accessory cover 70 is fixed to the cover 62 by a lock screw 74, and handling of the lock screw 74 is disabled when the circuit breaker is in ON-state. FIG. 11 shows ON-state of the circuit breaker (that is, when an operating handle is held in a forwardly-pulled posiion in the illustrated embodiment). This lock mechanism comprises cover members 45 disposed on both sides of the handle 41 which moves along with the movement of the handle 41. In an ON-state, the cover members 45 cover the lock screws 74, which prevents the accessory covers 70 from being opened. When the circuit breaker is in the OFF-state (that is, the operating handle is held in a rearwardly-tilted position in the illustrated embodiment) as shown in FIG. 12, the cover members 45 are located off of the lock screws 74, respectively, and therefore the lock screws 74 appear, which enables the accessory cover 70 to be opened by removing the lock screw 74. Similarly, the cover members 45 are located off the lock screws 74, enabling the accessory cover 70 to be opened in a TRIP condition of the circuit breaker.

While the above embodiment is described with reference to a three-pole circuit breaker, the present invention is not limited thereto, but arrangements of the present invention can be applied to a circuit breaker having a single pole, 2 poles, 4 poles, or more than 4 poles.

In this embodiment, although the main circuit is constituted by the power-side stationary contact carrier 11, load-side stationary contact carrier 17 and movable contact carrier 14, there may be used an arrangement in which a main circuit, constituted by a power-side stationary contact carrier as used in the conventional construction and a movable contact carrier connected to the load, and such alternative arrangement can be contained in a main circuit case made of an insulating material, and an arrangement of the present invention can be used wherein the opening-closing trip mechanism portion, the trip device and accessory installation areas are totally isolated and/or insulated from the main circuit.

What is claimed is:

1. A circuit breaker comprising:

a main circuit including a power-side stationary conductor representing a power-side terminal, a load-side stationary conductor representing a load side terminal and a movable conductor electrically connecting and disconnecting said power-side stationary conductor and said load-side stationary conductor;

a circuit breaker case, said circuit breaker case including an accessory chamber for containing therein at least one of a breaker tripping mechanism and breaker accessories; and a main circuit case disposed within said circuit breaker case, and at least partially enclosing and electrically isolating said main circuit for completely isolating said main circuit from exposure within said accessory chamber.

2. A circuit breaker comprising:

a main circuit including a power-side stationary conductor representing a power-side terminal, a load-side stationary conductor representing a load side terminal and a movable conductor electrically connecting and disconnecting said power-side stationary conductor and said load-side stationary conductor;

a circuit breaker case, said circuit breaker case including an accessory chamber for containing therein at least one of a breaker tripping mechanism and breaker accessories; and a main circuit case disposed within said circuit breaker case, and at least partially enclosing and electrically isolating said main circuit so that said main circuit is nowhere exposed in said accessory chamber.

3. A circuit breaker comprising:

a main circuit including a power-side stationary conductor representing a power-side terminal, a load-side stationary conductor representing a load side terminal and a movable conductor electrically connecting and disconnecting said power-side stationary conductor and said load-side stationary conductor;

an opening-closing trip mechanism mechanically connected to said movable conductor;

a main circuit case containing said main circuit to totally prevent exposure of said main circuit to said opening-closing trip mechanism and exposure of said main circuit within an accessary chamber, said main circuit case being made of an insulating material;

a tripping device for causing said opening closing trip mechanism to break electrical conduction along said main circuit when a current in said main circuit exceeds a threshold value; and a circuit breaker case including said accessary chamber for containing therein at least one of said opening-closing trip mechanism and breaker accessories;

wherein said main circuit case is at least partially contained within said circuit breaker case.

4. A circuit breaker comprising:

a main circuit including a power-side stationary conductor representing a power-side terminal, a load-side stationary conductor representing a load side terminal and a movable conductor electrically connecting and disconnecting said power-side stationary conductor and said load-side stationary conductor;

an opening-closing trip mechanism mechanically connected to said movable conductor;

a main circuit case containing said main circuit therein and made of an insulating material;

a tripping device for causing said opening-closing trip mechanism to break electrical conduction along said main circuit when a current in said main circuit exceeds a threshold value; and a circuit breaker case including an accessary chamber for containing therein at least one of said opening-closing trip mechanism and breaker accessories;

wherein said main circuit case is totally contained within said circuit breaker case, and said main circuit case totally prevents electrical exposure of said main circuit to internal areas of said circuit breaker case which are outside said main circuit case.

5. A circuit breaker according to claim 1, wherein said breaker tripping mechanism includes a connecting lever for transmitting a movement of said breaker tripping mechanism, wherein said breaker tripping mechanism is disposed outside of said main circuit case, and said connecting lever is made of electrical insulating material.

6. A circuit breaker according to claim 3, wherein said tripping device is activated by a magnetic flux transmitted through an insulating material.

7. A circuit breaker according to claim 3, wherein said tripping device is attached to said main circuit case so as to be electrically isolated from said main circuit.

8. A circuit breaker comprising:

a main circuit including a power-side stationary conductor representing a power-side terminal, a load-side stationary conductor representing a load side terminal, and a movable conductor electrically connecting said power-side stationary conductor and said load-side stationary conductor together on an ON operation;

an opening-closing trip mechanism disposed outside of said main circuit case and mechanically connected to said movable conductor;

a main circuit case containing said main circuit; and a trip device for causing said opening-closing trip mechanism to break said main circuit when a current in said main circuit exceeds a threshold value; and a circuit breaker case containing said main circuit case therein;

wherein said main circuit case is made of an insulating material and is adapted to totally prevent exposure of said main circuit to internal areas of said circuit breaker case which are outside said main circuit case, and said opening-closing trip mechanism is connected to said movable conductor through an insulating material.

9. A circuit breaker comprising:

a main circuit including a power-side stationary conductor representing a power-side terminal, a load-side stationary conductor representing a load side terminal, and a movable conductor electrically connecting said power-side stationary conductor and said load-side stationary conductor together on an ON operation;

an opening-closing mechanism mechanically connected to said movable conductor;

a main circuit case containing said main circuit;

a circuit breaker case containing said main circuit case therein; and a trip device for causing said opening-closing mechanism to break said main circuit when a current in said main circuit exceeds a threshold value;

wherein said main circuit case is made of an insulating material and is adapted to totally prevent exposure of said main circuit to internal areas of said circuit breaker case which are outside said main circuit case, and said opening-closing mechanism is disposed outside of said main circuit case and is electrically insulated from said main circuit, and said trip device includes a transmission mechanism for transmitting an operation of said trip device to said opening-closing mechanism, and said transmission mechanism is disposed outside of said main circuit case and is electrically insulated from said main circuit.

10. A circuit breaker comprising:

a main circuit including a power-side stationary conductor representing a power-side terminal, a load-side stationary conductor representing a roadside terminal, and a movable conductor electrically connecting said power-side stationary conductor and said load-side stationary conductor together on an ON operation;

an opening-closing mechanism mechanically connected to said movable conductor;

a main circuit case containing said main circuit;

a circuit breaker case containing said main circuit case therein; and a trip device for causing said opening-closing trip mechanism to break said main circuit when a current in said main circuit exceeds a threshold value;

wherein said main circuit case is made of an insulating material and is adapted to totally prevent exposure of said main circuit to internal areas of said circuit breaker case which are outside said main circuit case, and said opening-closing trip mechanism is disposed outside of said main circuit case, and is connected to said movable conductor through an insulating material; and said trip device includes a fixed core which is disposed inside of said main circuit case, and is located in the vicinity of one of said power-side stationary conductor and said load-side stationary conductor, and a movable core which is disposed outside of said main circuit case, and is so arranged that a magnetic circuit is formed between said moving core and said fixed core, and a transmission mechanism for transmitting an operation of said movable core to said opening-closing trip mechanism.

11. A circuit breaker comprising:

a casing;

a main circuit including a power-side stationary conductor representing a power-side terminal, a load-side stationary conductor representing a loadside terminal and a movable conductor electrically connecting and disconnecting said power-side stationary conductor and said load-side stationary conductor;

an opening-closing mechanism mechanically connected to said movable conductor;

a main circuit case contained in said casing and containing said main circuit and made of an insulating material and is adapted to totally prevent exposure of said main circuit to internal areas of said casing which are outside said main circuit case;

a trip device for causing said opening-closing mechanism to break said main circuit when a current in said main circuit exceeds a threshold value;

an installation portion disposed in said casing for installing an interior accessory; and an accessory cover disposed on a surface of said casing for covering said installation portion;

wherein said opening-closing mechanism, said main circuit case, and said trip device are disposed in said casing, and said opening-closing mechanism and said trip device are electrically insulated from said main circuit.

12. A circuit breaker according to claim 6, further comprising a locking device for locking said accessory cover in a closed position.

13. A circuit breaker according to claim 12, wherein said locking device is effected when the circuit breaker is in an ON position.

14. A circuit breaker comprising:

a main circuit including a power-side stationary conductor representing a power-side terminal, a load-side stationary conductor representing a load-side terminal and a movable conductor electrically connecting and disconnecting said power-side stationary conductor and said load-side stationary conductor;

a circuit breaker case, said circuit breaker case including an accessory chamber for containing at least one of a breaker tripping mechanism and breaker accessories; and a main circuit case contained within said circuit breaker case, said main circuit case totally isolating and preventing electrical exposure of said main circuit to internal areas of said circuit breaker case which are outside said main circuit case.

* * * * *